US006082585A

United States Patent [19]

Mader et al.

[11] Patent Number: 6,082,585

[45] Date of Patent: Jul. 4, 2000

[54] DOUBLE BAG FOR APPLICATION OF A FLUID SUBSTANCE

[75] Inventors: Helmut Mader, Hilpoltstein; Michael Krause, Nuremberg; Horst Schwietz, Allersberg; Franz Fritzmeier, Gunzenhausen; Karlheinz Baumann, Roth, all of Germany

[73] Assignee: Nutrichem Diät + Pharma GmbH, Roth, Germany

[21] Appl. No.: 09/196,400

[22] Filed: Nov. 19, 1998

[30] Foreign Application Priority Data

Nov. 20, 1997 [DE] Germany ..... 197 51 489

[51] Int. Cl.[7] ..... B65D 35/22

[52] U.S. Cl. ..... 222/83; 222/94; 383/38; 383/202

[58] Field of Search ..... 222/81, 83, 94, 222/107; 383/37, 38, 109, 202

[56] References Cited

U.S. PATENT DOCUMENTS

| | | | |
|---|---|---|---|
| 3,058,313 | 10/1962 | Robbins | 383/38 X |
| 4,411,358 | 10/1983 | Bennwik et al. | 383/38 X |
| 4,946,040 | 8/1990 | Ipenberg | 222/81 X |
| 4,979,644 | 12/1990 | Meyer et al. | 222/94 |
| 5,373,966 | 12/1994 | O'Reilly et al. | 222/94 |
| 5,779,894 | 7/1998 | Martensson | 383/109 X |

*Primary Examiner*—Kenneth Bomberg
*Attorney, Agent, or Firm*—Brown & Wood, LLP

[57] ABSTRACT

A double bag for application of a fluid substance including an outer bag having at least two adjoining each other edges, and an inner bag for receiving the fluid substance, located in the outer bag and having a length and a width which are shorter than inner dimensions of the outer bag, with the two adjoining each other edges of the outer bag and the inner bag defining together a free flooding region along the edges.

29 Claims, 8 Drawing Sheets

29
12
11
22
19
17

29
12
11
19
22
20
17

29
12
11
20
19
17
22

29
12
11
20
19
20
22
17

29
12
20
19
11
20
22
17

DOUBLE BAG FOR APPLICATION OF A FLUID SUBSTANCE

BACKGROUND OF THE INVENTION

1. Field of the Invention

The present invention relates to a double bag for application of a fluid substance, in particular a nutrient solution, and including an outer bag having at least two adjoining each other edges, and an inner bag containing the fluid substance and located in the outer bag, with the fluid substance flowing, at least partially, into the outer bag upon opening of the inner bag.

2. Description of the Prior Art

A double bag of the above-described type is disclosed, e.g., in German application 196 00 530.2. These double bags are particularly used for storage and administering of prepared nutrient solutions. The solutions are administered to patients, e.g., with so-called sonde systems. With these systems, a conventional intake of food after an operative connection is not possible.

The nutrient solutions usually contain substances necessary for supporting life such as proteins, fats, carbohydrates, minerals, vitamins, and micronutrients.

Originally the containers for storing and administering of the nutrient solutions were made of glass. However, glass containers have serious drawback, it is difficult to transport them, they require much space for their storage, and they are difficult to handle during use. Another very serious drawback of the glass containers consists in that during administering of a solution, air is sucked in. This presents a risk of germs penetrating into the nutrient solution, which is dangerous to the patient.

The foregoing drawbacks were substantially eliminated with the development of plastic containers for the nutrient solutions. In order to protect them from the influence of light, oxygen, sun, temperature fluctuations, ets . . . , the solutions are stored in the inner, opaque and air—tight bag, which is placed into the outer bag, and the solution flows from the inner bag into the outer bag upon opening of the inner bag. The outer bag is preferably at least partially transparent so that the condition of the nutrient solution can be checked before use.

Plastic or foil containers or bags better protect the solutions from the environmental influence then conventional glass containers. Upon discharge of the container or the bag, no space remains which can be filled by air, rather the size of a bag is reduced with the fluid substance having been discharge.

However, the above-described double bag containers have a serious drawback which consists in that the bags at least partially impede the flow of the fluid substance. E.g., an adhesion between bag walls can take place. The adhesion can completely block the flow of the fluid substance from the inner bag into the outer bag and the discharge from the outer bag. Another drawback of a double bag consists in that often a substantial amount of the fluid substance remains in the bags, and its a practically complete discharge is not possible.

Accordingly, an object of the present invention is a double bag of the above-described type which would provide for an improved discharge of a fluid substance.

SUMMARY OF THE INVENTION

This and other objects of the present invention, which will become apparent hereinafter, are achieved by providing an inner bag the length and width of which are smaller than the inner dimensions of the outer bag and which, together with the two adjoining edge of the outer bag, defines a flooding region along the edges, between the two bags. In the use position of the double bag, upon opening of the inner bag, the fluid solution pours into the flooding region, creating a torrent effect which results in a rapid rise of the fluid surface in the outer bag along the outer,wall of the inner bag. The free flooding region provides for an "initial surge" which separates the lower region of the outer bag from the outer wall of the inner bag, thus insuring an unobstructed flow of the fluid substance in the outer bag. Advantageously, at least one edge of the outer bag is formed as a rounded edge which permits to further increase the free flooding region along this edge. Therefore, the adjoining edges of the outer bag should not be sharp, rather they should be rounded, thereby increasing the flooding region between the inner and outer bag and favorably influencing the "initial surge." The rounded edges can simultaneously define a sight window with a scale which also permits to observe the condition and the level of the fluid substance.

In order to provide for such a free flooding region separating the outer bag from the inner bag, advantageously, the inner bag is eccentrically secured in the outer bag. The eccentric mounting of the inner bag is effected in such a manner that in the use position of the double bag, the inner bag is secured in the outer bag in an upward-shifted position.

Advantageously, the two adjoining edges of the outer bag form a right angle corner region in which or closely adjacent thereto, a discharge device is located. Advantageously, the double bag according to the present invention is discharged at the corner region, in which the fluid substance can accumulate, whereby it is insured that with an appropriate suspension of the double bag, a practically complete emptying of the double bag is insured. The discharge device is arranged at a smallest practically possible distance from the discharge corner region. The only limitation against placing the discharge device directly in the corner is the presence of a glue or welding seam between the wall of the outer bag and the discharge device.

Advantageously, the inner bag also has a corner region which is being open during the use of the double bag. With an appropriate suspension of the double bag, the fluid can be completely discharged through this region of the inner bag.

Advantageously, the corner regions of the inner and outer bags, through which discharge takes place, are located adjacent to each other so that neither in the inner bag nor in the outer bag, any noticeable residue of the fluid substance remains, resulting in a complete automatic discharge of the fluid substance from the double bag.

For opening of the inner bag, according to a preferred embodiment of the present invention, an opening device is secured on the outer bag, preferably by welding, in a leakage proof manner. The opening device includes a displaceable tapping pin which pierces at least one wall of the inner bag to provide a hole through which the fluid substance can flow out. Obviously, other means for opening the inner bag can be used. Thus, a breaking point can be provided in the inner bag, preferably in the corresponding corner region, which is severed under an adequate pressure, opening the inner bag. Also, the opening device can be so modified that it cuts off the entire corner, providing for a complete discharge of the fluid substance from the inner bag.

According to a further preferred embodiment of the present invention, the opening device and the discharge device are spaced from each other so that in the use position, the discharge device of the outer bag is located beneath the opening device. The opening device and the discharge device can be considered to be self-contained inventions independent of the double bag.

BRIEF DESCRIPTION OF THE DRAWINGS

The features and objects of the present invention will become more apparent, and the invention itself will be best understood from the following detailed description for the preferred embodiments when read with reference to the accompanying drawings, wherein.

DETAILED DESCRIPTION OF THE PREFERRED EMBODIMENTS

Figure 1:
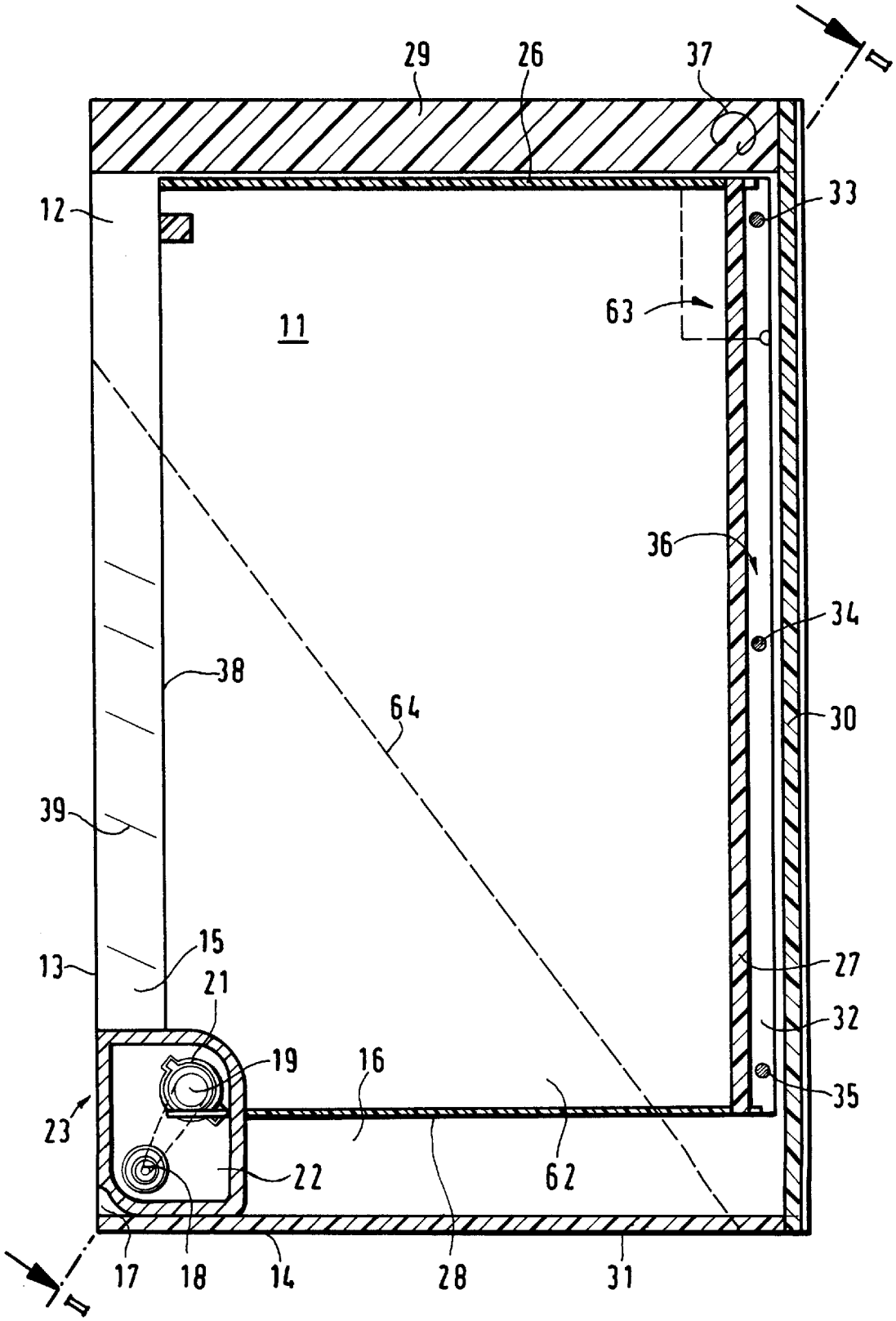
FIG. 1 shows a side cross-sectional view of a double bag for application of a fluid substance according to the present invention.

A double bag according to the present invention, a preferred embodiment of which is shown in FIG. 1, includes an inner bag 11 and an outer bag 12. In the embodiment shown in FIG. 1, both the inner bag 11 and the outer bag 12 have a rectangular cross-section. The inner bag 11 is formed of a light and gas impermeable plastic-metal laminate.

inner bag 11 has a non-sealed edge 38, with other edges of the inner bag 11 being associated with sealing seams 26, 27 and 28. The sealing seam 27, which is located opposite the non-sealed edge 38, simultaneously limits a rib 32 provided on the inner bag 11. The rib 32 is designed for securing the inner bag 11 in the outer bag 12. The rib 32 is secured to the outer bag at weld points 33, 34, 35 so that the inner bag 11 is fixedly secured in the outer bag 12. Such an arrangement provides for a reliable perfect leakage proof sealing of the outer bag 12. In addition, the nutrient solution is not subjected to any further thermal load. If the securing as well as seaving of the outer bag 12 were effected along the sealing seams of the inner bag, leakage would have been possible because the welding process would have involved partial sealing of two or four foil sheets. Because of their different thicknesses, leakage would have been possible in the transition region from two to four foil sheets.

The outer bag 12 likewise has a non-sealed edge 13. All of the other edges of the outer bag 12 are likewise provided with sealing seams designated with reference numerals 29, 30, 31. In the outer bag 12, the sealing seam 30, which is located opposite the non-sealed edge 13 is arranged outside of the inner bag 12, adjacent to the rib 32. The upper, in the operational position, sealing seam 29 of the outer bag 12 is particularly wide and has a width from about 8 mm to about 20 mm, preferably, of about 14 mm. A circular or an omega-shaped suspension opening 37 is formed in the upper wide seam 29.

The outer bag 12 is transparent at least in a region of its side wall 62, preferably, also in a region of a second side wall so that the level and conditions of the fluid substance in both the inner bag 11 and the outer bag 12 can be checked. The upper region of the outer bag 12 can have printed instruction. In an advantageous embodiment of the present invention, the print extend to a broader line 34. A transparent sight window 63 serves for observing the foil region of the inner bag 11. This region of the inner bag 11 can bear a control or production number. The sight window 63 permits to read the control or test number after filling of the inner bag 11 and after securing it in the outer bag 12.

The outer dimensions of the inner bag 11 are smaller than the inner dimensions of the outer bag 12, and a free flooding region 15, 16 is provided between the inner bag 11 and the outer bag 12.

As shown in FIG. 1, the inner bag 11 is eccentrically arranged with respect to the outer bag 12. Specifically,the inner bag 11 is displaced from a central position toward the suspension opening 37 in the outer bag 12. An openable location 20 is formed in the inner bag 11. It is in this location that the inner bag 11 is opened upon use of the double bag. For opening the inner bag 11, an openable device 21 is provided at a wall of the inner bag 11 in its openable location or region 20. The opening device 21 is secured on the outer bag 12. The opening region 20 is provided in a corner region 19 of the inner bag 11. Preferably, the corner region 19 is located as far as possible from the region of the inner bag 11 adjoining the suspension opening 37.

A discharge device 18 of the double bag is provided in a corner region 17 of the outer bag 12 defined by an intersection of edges 13 and 14 of the outer bag 12. The discharge device 18 and the opening device 21 are supported on a common support plate 22 in a fixed position relative to each other. The distance between the two devices amounts, preferably, to from 5 to 15 mm, preferably 10 mm. The support plate 22, together with the opening and discharge devices mounted thereon, is welded to the wall of the outer bag 12 without a possibility of leakage therebetween.

Upon actuation of the opening device 21, the inner bag 11 opens in its opening region 20, and the fluid in the inner bag 11 at least partially flows into the outer bag 12.

Figures 2A, 2B, 2C, 2D, 2E:
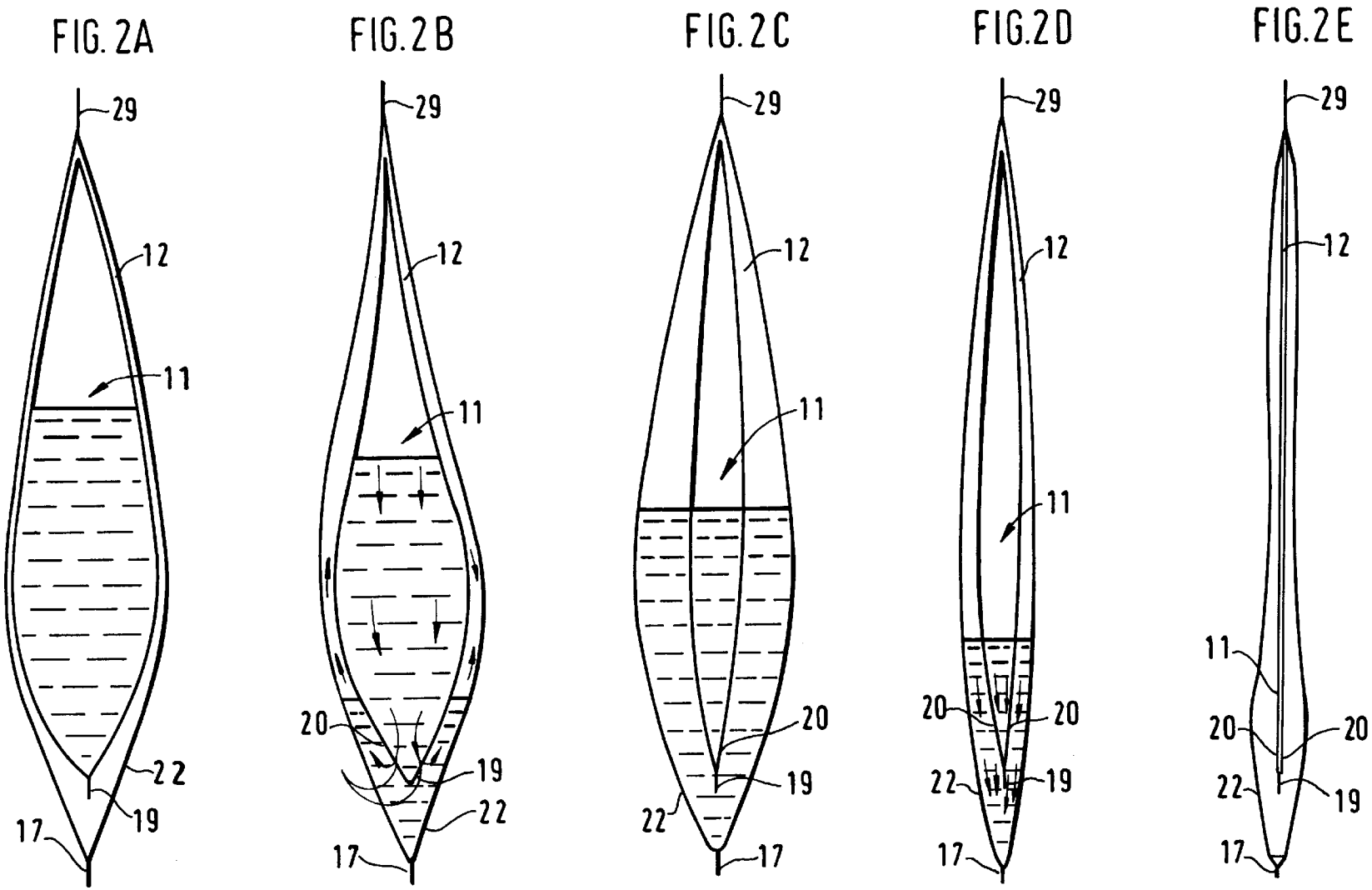
FIG. 2*a* shows a cross-sectional view along line 2—2 in FIG. 1 illustrating the condition of the inner bag before opening.
FIG. 2*b* shows the same view as FIG. 2*a* illustrating the condition of the inner bag during the flow of liquid from the inner bag into the outer bag.
FIG. 2*c* shows a view similar to that shown in FIGS. 2*a*–2*b* and illustrating the level of fluid in both the inner and outer bags before withdrawal of the fluid substance from the outer bag.
FIG. 2*d* shows a view similar to that shown in FIGS. 2*a*–2*c* and illustrating the conditions of the inner and outer bags during withdrawal of the fluid substance.
FIG. 2*e* shows a view similar to that shown in FIGS. 2*a*–2*d* and illustrating the conditions of the inner and outer bags after the fluid substance has been practically completely withdrawn.
Figure 3A:
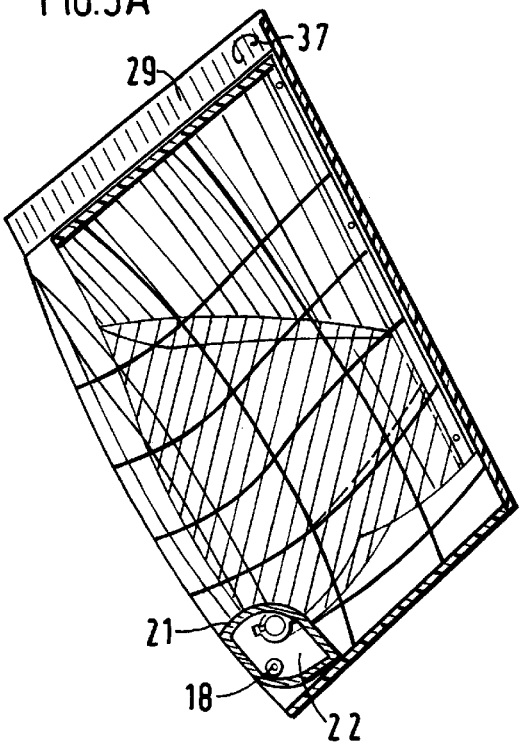
FIG. 3*a* shows a perspective view of the double bag according to the present invention before opening of the inner bag.
Figure 3B:
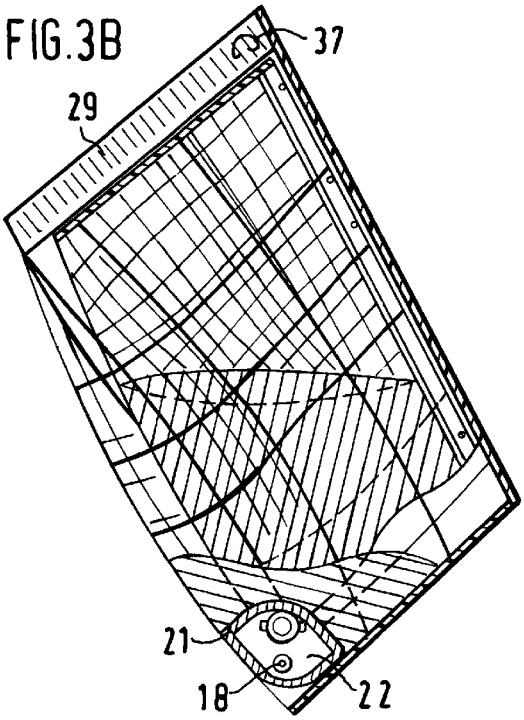
FIG. 3*b* shows the same view as FIG. 3*a* during flow of fluid substance from the inner bag into the outer bag.
Figure 3C:
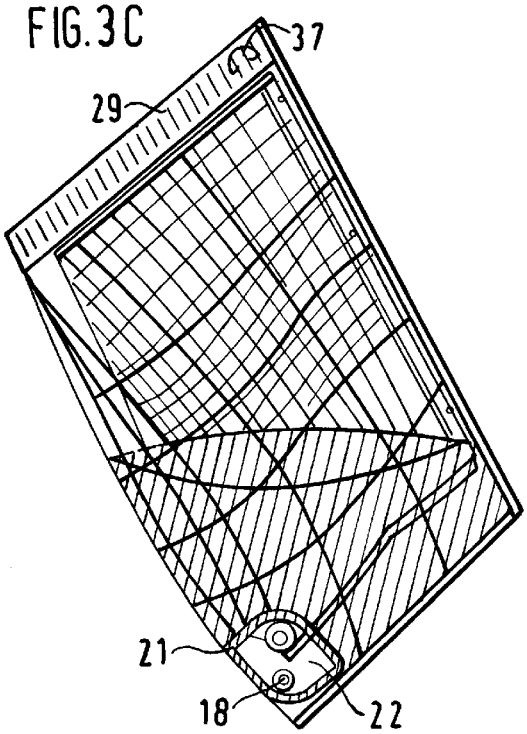
FIG. 3*c* shows the same view of FIGS. 3*a*–3*b* before withdrawal of the fluid substance from the outer bag, with the fluid level being substantially the same in both inner and outer bag.
Figure 3D:
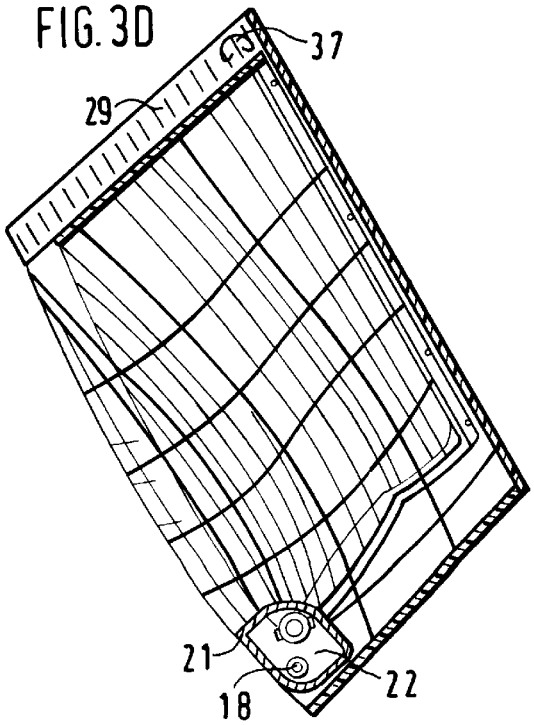
FIG. 3*d* shows the same view as FIGS. 3*a*–3*c* when the fluid substance has been practically completely withdrawn.

The flow of fluid will now be explained with reference to FIGS. 2*a*–2*c*. At that, for the sake of clarity, the opening device 21 and the discharge device 18 are not shown in FIG. 2*a*–2*e*. FIG. 2*a* shows the double bag with a closed inner bag 11. An inner wall of the outer bag 12 at least partially abuts the outer wall of the inner bag 11.

FIG. 2*b* shows a condition of the double bag after actuation of the opening device 21. The fluid substance flows from the inner bag 11 into the flooding area 15, 16. As a result of gush or flow of the fluid substance from the inner bag 11, it quickly becomes much thinner. At the same time, the walls of the outer bag 12 expand outwardly, at least in the lower region, and the level of fluid between the walls of the inner bag 11 and the outer bag 12 rapidly increases. The adhesion between the walls of the inner bag 11 and the outer bag 12 practically disappears, and the inner bag 11 normally collapses. The fluid substance flow is based on a principle of interconnected pipes, and the fluid substance rapidly fills the outer bag 12.

In a short while, the fluid substance reaches the same level in both the inner bag 11 and the outer bag 12, as shown in FIG. 2*c*. This condition of equilibrium can be reproduced. A scale for checking and control of the amount of fluid can be provided on the transparent outer bag 12.

FIG. 2*d* shows the double bag in a condition in which the fluid substance is discharged through the discharge device 18. At that, the fluid level is reduced in both the inner bag 11 and the outer bag 12 substantially uniformly. The double bag contracts, and the fluid flows from the double bag, without a need in suction of air, and no suction of air takes place.

FIG. 2*e* shows an empty double bag. The amount of fluid, which remains in the corner region 19 of the inner bag 11 and in the discharge region 17 of the outer bag 12, is negligible. The inner bag 11 and the outer bag 12 become empty without application of external forces. The separation of walls in the lower region of the outer bag 12 is obtained with the support plate 22 which is welded to the wall of the outer bag 12. The support plate 22, thus, separates the walls of the outer bag 12 in the discharge region 17.

FIGS. 3*a*–3*d* show perspective views illustrating flow of the liquid substance from the double bag. For better clarity, the non-transparent inner bag 11 is shown as being transparent. The views show flooding of the free regions 15, 16 and flow of the fluid substance from these regions along the wall of the inner bag 11 upward.

FIGS. 3*a*–3*d* show the double bag in its use position so that the sealing seam 29 of the outer bag 12 and the suspension opening 37 and located at the top, and the discharge device 18 is located at the bottom. Also, the opening location 20 of the inner bag 11 is in a region of the maximum thickness. During the discharge of the double bag, the fluid substance flows into the corner region 19 of the inner bag 11 and into the discharge region 17 of the outer bag 12 in a funnel-like manner and is practically completely discharged. The attachment of the inner bag 11 to the outer bag 12 with an aid of the rib 32 also can be seen in FIGS. 3*a*–3*d*. As shown, the rib 32 of the inner bag 11 is welded to the outer bag 12 with weld points or spots 33, 34, 35.

Figure 4A:
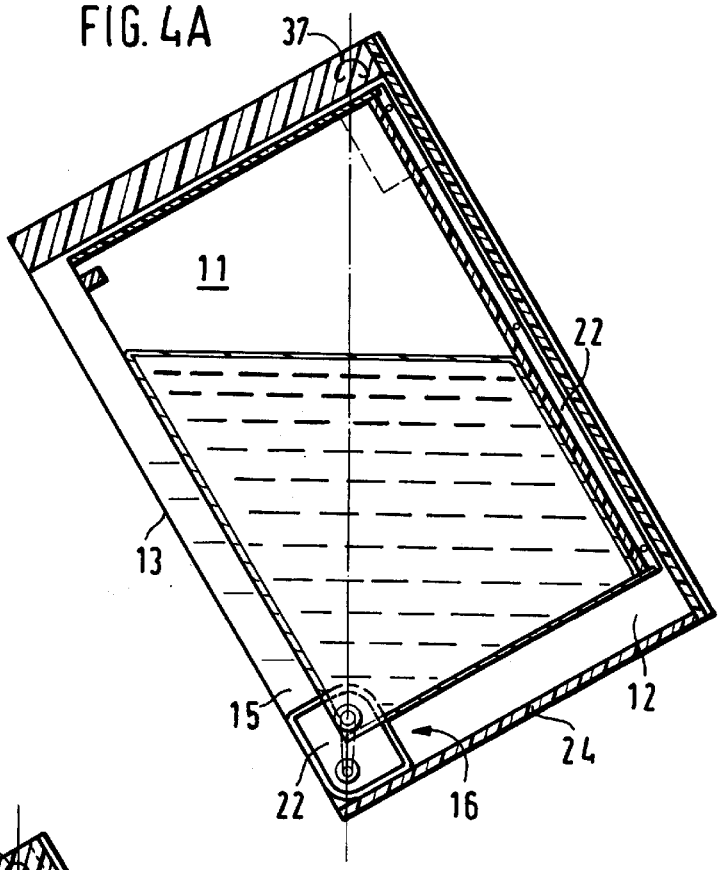
FIG. 4*a* shows a side cross-sectional view of a double bag according to the present invention illustrating the condition of the inner bag before opening.
Figure 4B:
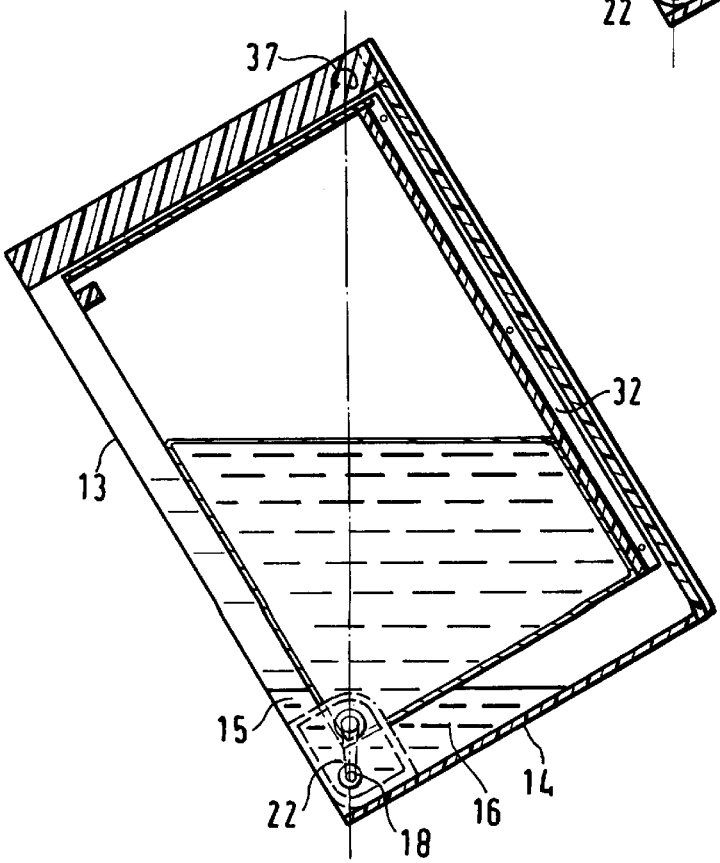
FIG. 4*b* shows the same view as FIG. 4*a* during flow of fluid substance form the inner bag into the outer bag.

FIGS. 4*a*–4*e* illustrate the process of fluid discharge from the double bag according to the present invention. FIG. 4*a* shows a condition at which the fluid substance is enclosed in the closed inner bag 11 and is protected from external conditions by preferably light and gas impermeable wall which separates the inner bag 11 from the outer bag 12. From the surrounding environmental conditions, the fluid substance is protected twice, by walls of both the inner bag 11 and the outer bag 12.

Upon opening of the inner bag 11 in the opening region 20 with the opening device 21, which will be described in detail below, the fluid substance at least partially flows into the outer bag 12 which, preferably, is transparent at least in some areas. This permits to inspect the fluid substance which flows from the free flooding region 15, 16 and between the walls of the inner bag 11 and the outer bag 12 upward, before administering it to a patient. The scale 39, which is provided in the transparent region of the outer bag 12, permits to check the level of the fluid substance.

Figure 4C:
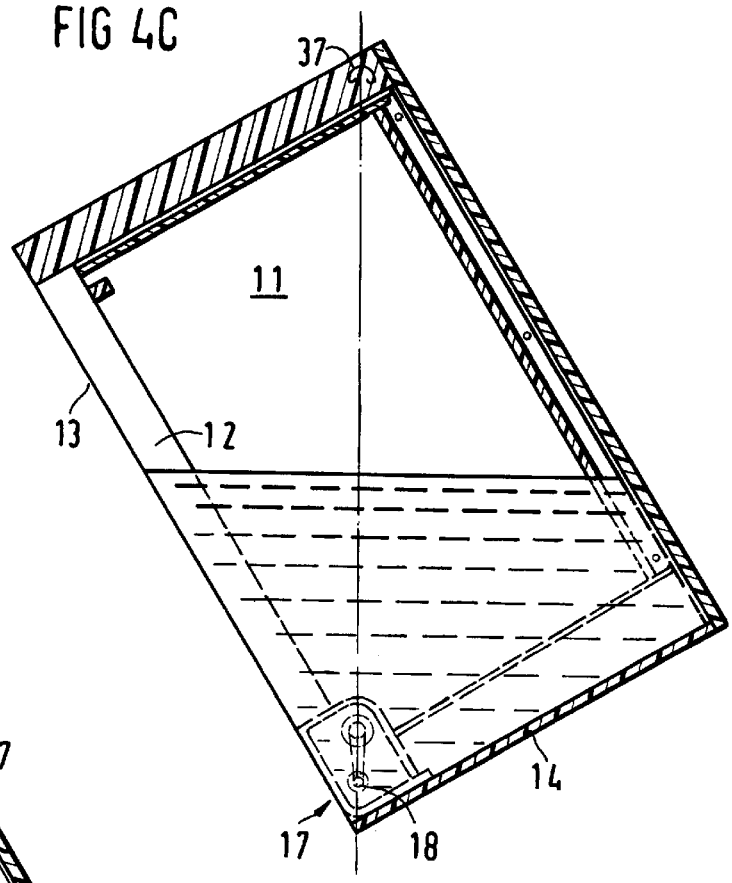
FIG. 4*c* shows the same view of FIGS. 4*a*–4*b* before withdrawal of the fluid substance form the outer bag, with the fluid level being substantially the same in both inner and outer bag.

FIG. 4*c* shows a condition of the double bag in which the level of the fluid substance in both the inner bag 11 and the outer bag 12 is substantially the same. Due to the existence of the flooding region 15, 16 and the position of the inner bag 11 in the outer bag 12, this level is attained extremely rapidly.

Figure 4D:
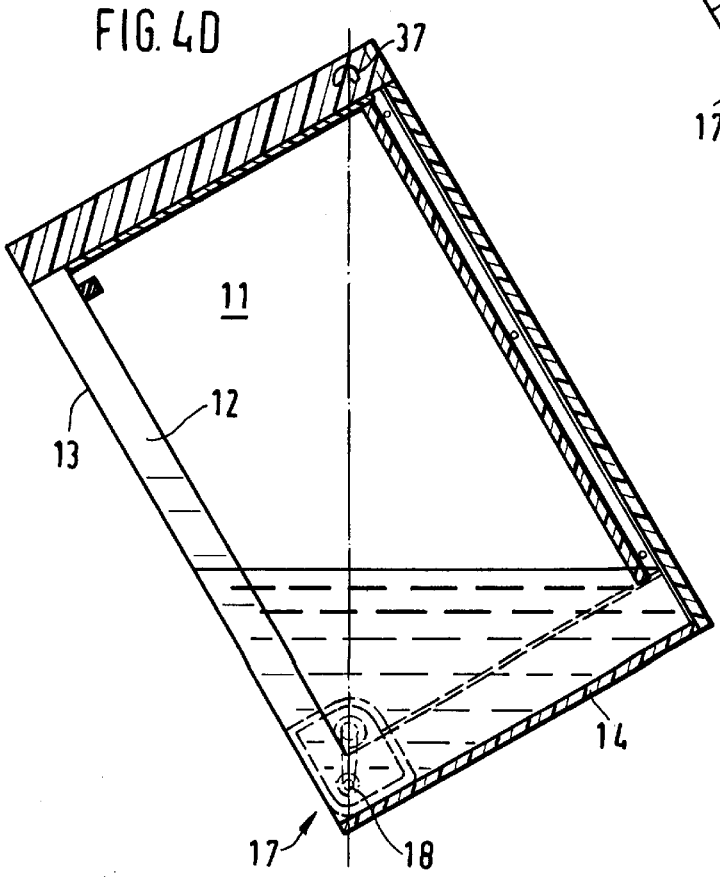
FIG. 4*d* show the same view as FIGS. 4*a*–4*c* illustrating the condition of the inner and outer bags during withdrawal of the fluid substance.

FIG. 4*d* shows a condition of the double bag at which a portion of the fluid substance has already been discharged from the outer bag 12 through the discharge device 18.

Figure 4E:
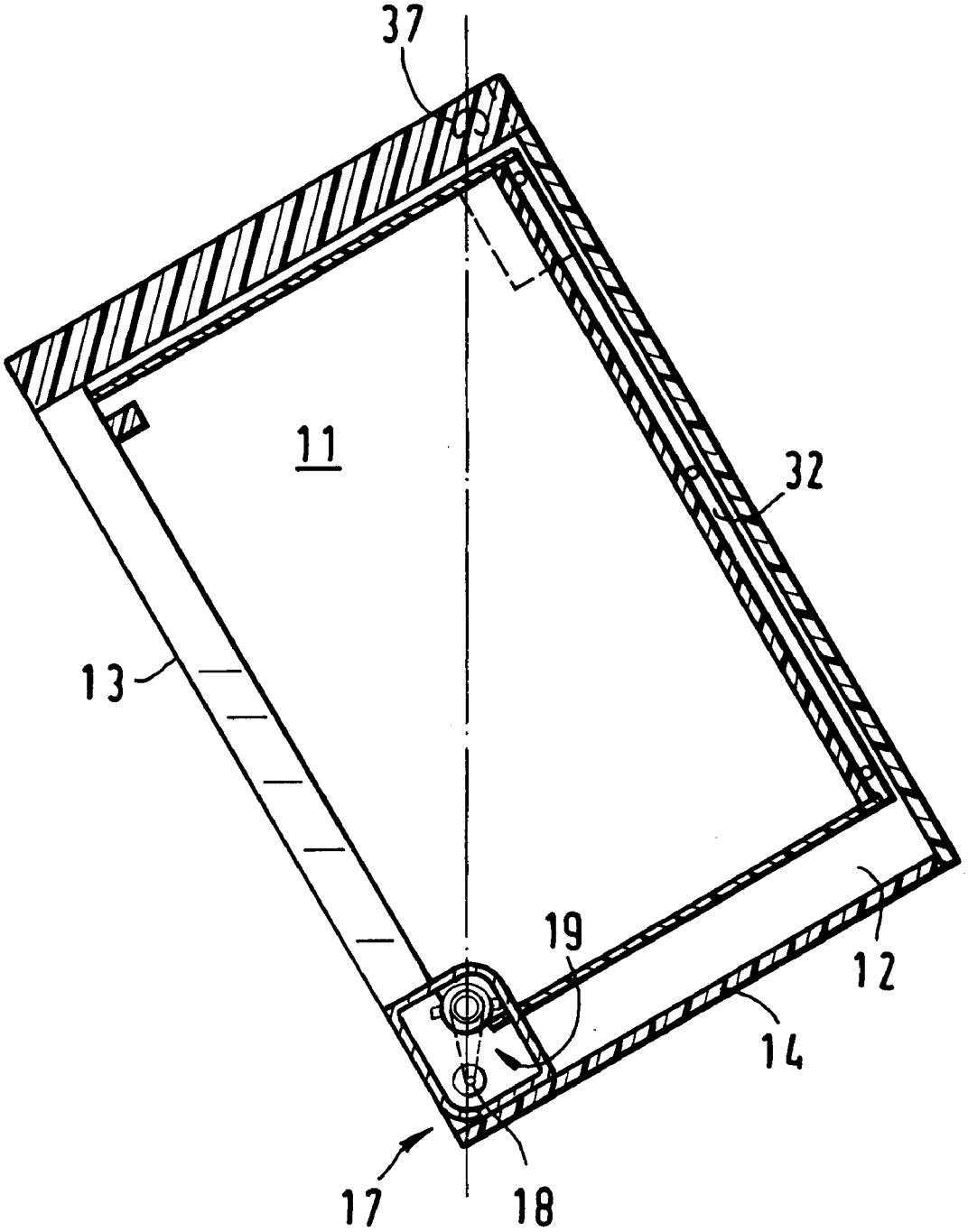
FIG. 4*e* shows the same view as FIGS. 4*a*–4*d* after the fluid substance has been practically completely withdrawn.

FIG. 4*e* shows a condition of the double bag at which the fluid substance has practically completely flown out from the inner bag 11 and the outer bag 12. The residual amount of the fluid substance, which remained in the corner region 19 of the inner bag 11 and in the discharge region 17 of the outer bag 12, is marginal. Such a substantially complete discharge from a double bag cannot be achieved with known solutions of the prior art, and such a complete discharge forms an important aspect of the present invention.

FIGS. 5*a*–5*d* illustrate the construction and functioning of the opening device 21. In the preferred embodiment of the present invention, both the opening device 21 and the discharge device 18 ar mounted on the same support plate 22. The support plate 22 can be formed of a plastic material as an injection-molded part. The plastic support plate 22 has an upright cylinder 43 which limits an opening 47 in the support plate 22. A pressure cup 48 surrounds the cylinder 43 and is displaced therealong. The pressure cup 48 includes a piston 44 which preferably sealingly displaces in the cylinder 43.

The piston 44 has, at its end remote from the upper end surface of the pressure cup 48, a tapping pin 40 which serves for opening the inner bag 11 in the opening region 20. The tapping pin 40 has two crossing cutting ribs 41,42, forming a peak at their free ends. The cross profile of the two cutting ribs 41, 42 permits flow of the fluid substance through a hole in the opening region 20 while the tapping pin 40 still remains in the inner bag 11.

The support plate 22, which surrounds both the inner bag 11 and the outer bag 12 has, at an end thereof opposite to the cylinder 43, a pot-shaped abutment 45 into which the tapping pin 40 submerges after penetrating through the walls of the inner bag 11.

The operation of the opening device 21 will now been described with reference to FIGS. 5*a*–5*d*.

Figure 5A:
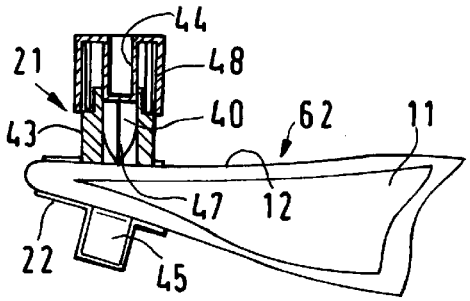
FIGS. 5*a*–5*d* show a cross-sectional view of an opening device for use in a double bag according to the present invention in different operational positions thereof.

In the position shown in FIG. 5*a*, the tapping pin 40 is located in the cylinder 43 so that tapping of the inner bag 11 is not possible.

Figure 5C:
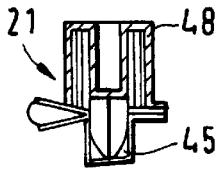
Figure 5B:
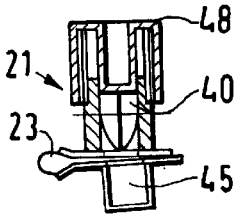
Figure 5D:
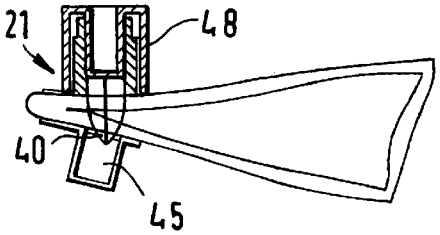

Upon displacement of the pressure cup 48 toward the abutment 45, which remains stationary (FIG. 5*b*), the tapping pin 40 penetrates through both wall of the inner bag 11 and submerges into the abutment 45 (FIG. 5*c*). As soon as the pressure cup 48 or the abutment 45 is released, a spring force of the plate 22 causes separation of the outer bag 12 from the inner bag 11, and the tapping pin 40 is withdrawn from the abutment 45. However, the tapping pin 40 remains in the inner bag 11, with the cross profile of the cutting ribs 41, 42 providing for flow of the fluid substance from the inner bag 11 into the outer bag 12.

Figure 6B:
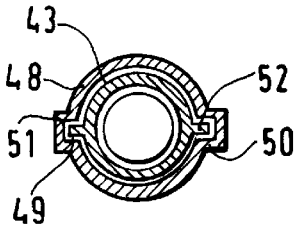
FIG. 6*b* shows a cross-sectional view along line 6*b*—6*b* in FIG. 6*a;*
Figure 6C:
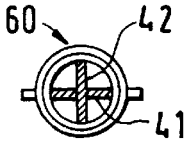
FIG. 6*c* shows a cross-sectional view along line 6*c*—6*c* in FIG. 6*a*.
Figure 6A:
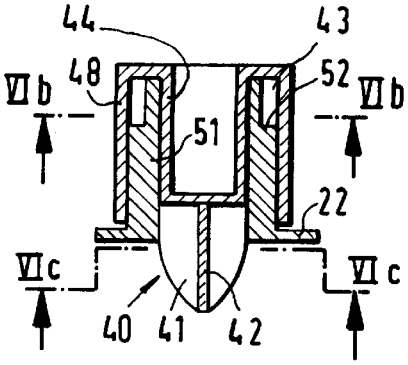
FIG. 6*a* shows a cross-sectional view similar to that of FIG. 5*a* but showing the opening device at an increased scale.

FIG. 6*a* shows the pressure cup 48, together with the piston 44 and the tapping pin 40, at an increased scale. The pressure cup 48 should be rotated relative to the cylinder 43 a certain amount so that grooves 49, 50 of the pressure cup 48 coincide with flanks 51, 52 on the cylinder 43. Only in that position, the pressure cup 48 can be displaced along the cylinder 43. The position of the grooves 49, 50 of the pressure cup 48 and of the flanks 51, 52 of the cylinder 43 is shown in FIG. 6*b*.

FIG. 6*c* shows the bottom view from below of the tapping pin 40 showing the plan view of the cutting ribs 41, 42.

Figure 6D:
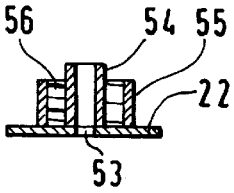
FIG. 6*d* shows a cross-sectional view of a discharge device for use in a double bag according to the present invention.

FIG. 6*d* shows a discharge device 18 which is like wise supported on the support plate 22, preferably, on the same side as the cylinder 43. The discharge device 18 includes a discharge nipple 54, which surrounds an opening 53 formed in the support plate 22, and a threaded sleeve 55 which surrounds the nipple 54 an is concentric therewith. The threaded sleeve 55 has an inner thread 56 which retains a coupling or a sealing element which can be screwed thereon.

Figure 7A:
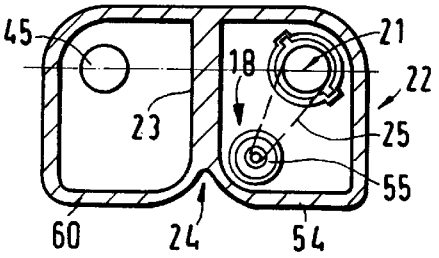
FIG. 7*a* shows a cross-sectional view of a support plate on which the opening and discharge devices for a double bag according to the present invention are supported.

FIG. 7*a* shows the support plate 22 in its unfolded position. The support plate 22 has two plates 57 and 58 separated by a book back-shaped web 23. The cylinder 43 and the discharge device 18 are supported on the first plate 57 and are formed integrally therewith. The pot-shaped abutment 45 is formed on the second plate 58 likewise integrally therewith.

The plate 22 has, on its inner, in the use position, side, a bay-shaped notch 24 (see FIG. 7*a*). This bay-shaped notch 24 has several functions. It prevents appearance of creases and tension cracks when the support plate 22 is welded or glued to the outer wall of the outer bag 12 in its unfolded condition. Further, the "sight glass effect" of the edge 13 of the outer bag 12 along the support plate 22 is improved. In its attached condition,the support plate 22 does not hinder observation of the region of the outer wall of the outer bag 12 in the corner region 17 in which presence of the fluid substance can be observed. Finally, the bay-shaped notch 24 permits to increase the free flooding region 15, 16 upon attachment of the support plate 22 to the wall of the outer bag 12.

The support plate 22 can be either flatly welded or glued to the wall of the outer bag 12 or can at least surround the region of the opening device 21 and the discharge device 18. The flat attachment of the support plate 22 is preferably effected by its welding along an circumferential seam. A punch-out opening 25 is formed in a side wall 62 of the outer bag 12. It is necessary that the side wall 62 of the outer bag 12 is punched out at least around the discharge device 18 and the opening device 21. The opposite side wall of the outer bag 12 should be punched out at least around the abutment 45. also, an entire surface inside the welding or glued edges beneath the support plate 22 can be punched out. A reliable discharge, which is effected bubble-free up to the last drop, is insured by punching out an oval segment which connects the discharge device 18 and the opening device 21.

Figure 7B:
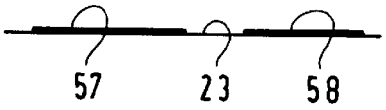
FIG. 7*b* shows a cross-sectional view along line 7*b*—7*b* in FIG. 7*a;*

As shown in FIG. 7*b*, the plates 57, 58 of the support plate 22 are much thicker than the connecting them look back-like web 23 or than the circumferential lip 60. The rearer thickness of the plate 57, 58 provides for mounting of the discharge device 18 and the opening device 21 and their operation.

FIGS. 8*a*–8*g* show different possible embodiments of the support plate 22. A support plate 22 shown in FIG. 8*a* has an offset 61 between the book back-like web 23 and the lip 60. In the embodiment shown in FIG. 8*b*, the lip 60 has greater radii in the inner region of the support plate 22, and the book back-like web 23 has a relatively substantial thickness.

Figure 8A:
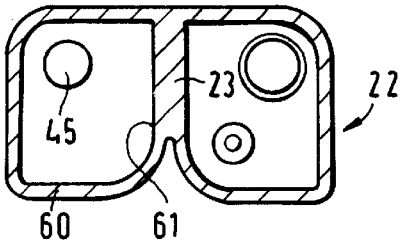
FIGS. 8*a*–8*g* show cross-sectional views of different embodiments of a support plate on which the opening and discharge devices for a double bag according to the present invention are supported.
Figure 8B:
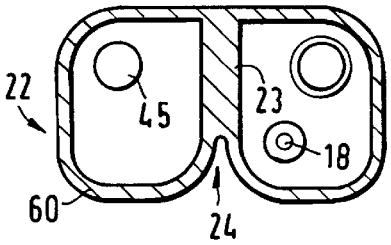
Figure 8C:
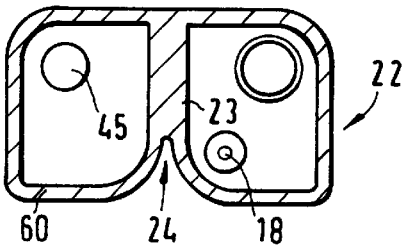

The embodiment of the support plate shown in FIG. 8*c* differs from that shown in FIG. 8*a* primarily by a greater thickness of the web 23. The width of the web 23 for a bag having a volume of 500 ml lies in a range between 4 and 8 mm, preferably, 6 mm.

Figure 8D:
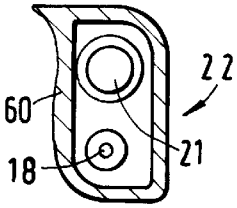
Figure 8E:
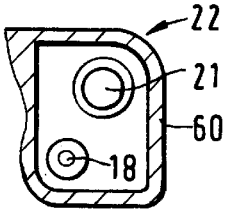

The embodiment of the support plate 22 shown in FIG. 8*d* is characterized in that the discharge device 18 and the opening device 21 are arranged along a line extending, upon attachment of the support plate 22 to the outer bag 12, parallel to the unsealed edge 13. In the embodiment of the support plate 22 shown in FIG. 8*e*, the discharge device 18 and the opening device 21 are arranged along a line which, with the support plate 22 being attached to the outer bag 12, forms an angle of about 35° with the unsealed edge 13 of the outer bag 12.

Figure 8F:
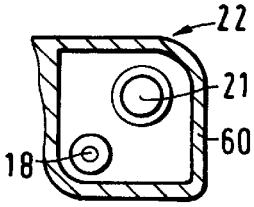

In the embodiment of the support plate 22 shown in FIG. 8*f*, the discharge device 18 and the opening device 21 extend along a line which forms with the unsealed edge 13 of the outer bag 12, with the support plate being attached to the outer bag 12, an angle of about 45°.

Figure 8G:
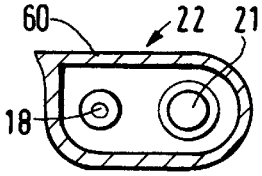

In the embodiment of the support plate 22 shown in FIG. 8*g*, the discharge device 18 and the opening device 21 extend along a line which extends to the unsealed edge 13 of the outer bag 12, with the support plate 22 being attached to the outer bag 12, an angle of about 90°. Thereby, the opening device 21 can be located in a segment of a circle of 90° adjacent to or above the discharge device 18. Preferably, the support plate 22 is so welded with the outer bag 12 that both the discharge device 18 and the opening device 21 are arranged inside of a common opening in the outer bag 12, with the outer bag 12 being provided with the punched out oval opening 25 and the openings 47 and 53 of the support plate 22 being provided at opposite ends of the punched out opening 25.

The outer bag 12 is preferably formed of a transparent plastic laminate, e.g., polyethylene—PET—polypropylene.

The outer bag 12 forms an additional barrier against a gas exchange. In addition, air or an inert gas, located in the space between the outer bag 12 and the inner bag 11, prevents rapid and brisk temperature fluctuations.

In the double bag according to the present invention, the opening device 21 provides, upon puncturing of the inner bag 11, for flow of the fluid substance from the inner bag 11 into the space between the inner bag 11 and the outer bag 12 where the fluid substance can be optically observed. It was unexpectedly found out that due to the communication principle of the double bag and the self-collapsing property of both the inner bag 11 and the outer bag 12, no ventilation for a complete discharge of the double bag is necessary.

It was unexpectedly found out that a perfect operation of the double bag is insured when the inner bag 11 is smaller than the internal dimensions of the outer bag 12 and is eccentrically secured in the outer bag 12, forming a free flood region 15, 16.

The transparency of the outer bag 12 provides for a sight-glass effect, with the "sight glass" being graduated in volume units. Also, as discussed above, a free volume is formed between the inner edges of the outer bag 12 and the edges of the inner bag 11. This free volume, together with the free volume of the "sight glass" defines the flooding region 15, 16 which provides for leveling of the fluid surface in both the inner bag 11 and the outer bag 12 in a very short time.

Numerous tests have shown that with the volume of the inner bag 11 of 500 ml, leveling of the fluid surfaces is effected in 9 sec±2 sec. With the inner bag 11 being fixed in the outer bag 12 without the formation of the flooding region 15, 16, this leveling would have taken more than 60 sec. If in this case, flooding had taken place, a thin film would have been formed on the surfaces, and an adhesive effect between the inner bag 11 and the outer bag 12 would have prevented the leveling of the fluid surface in the inner and outer bags. The leveling would have not been reproducible in a reproducible time period. These drawbacks would have prevented the clinical use of a double bag with out a flooding region. The above-listed drawbacks are absent in the inventive double bag.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A double bag for application of a fluid substance, comprising:

an outer bag having at least two adjoining each other edges;

an inner bag for receiving the fluid substance located in the outer bag, the inner bag having a length and a width which are shorter than inner dimensions of the outer bag;

a free flooding region formed between the two adjoining each other edges of the outer bag and the inner bag and extending along the edges;

a device for opening the inner bag and secured on the outer bag;

a discharge device arranged in a comer region of the outer bag defining by the at least two adjoining each other edges and spaced from the opening device, the discharge device being located beneath the opening device in a use position of the double bag; and a support plate on which the discharge device and the opening device are secure.

2. A double bag as set forth in claim 1, wherein the inner bag is eccentrically secured in the outer bag.

3. A double bag as set forth in claim 1, wherein the two adjoining edges of the outer bag form a substantially rectangular corner region, and wherein the double bag further comprises a discharge device arranged in the rectangular corner region.

4. A double bag as set forth in claim 3, wherein the inner bag has a corner region defining an openable location of the inner bag.

5. A double bag as set forth in claim 4, wherein the substantially rectangular corner region of the outer bag and the corner region of the inner bag face each other.

6. A double bag as set forth in claim 1, wherein the support plate, the discharge device and a part of the opening device form a one-piece member.

7. A double bag as set forth in claim 1, wherein the one-piece member is formed by an injection-molding process.

8. A double bag as set forth in claim 1, wherein the discharge device is spaced from the opening device by from 5 to 15 mm.

9. A double bag as set forth in claim 8, wherein the discharge device is spaced from the opening device by 10 mm.

10. A double bag as set forth in claim 1, wherein in the use position of the double bag, the opening device is located in a segment of circle of 90° from a vertical to a horizontal relative to the discharge device.

11. A double bag as set forth in claim 1, wherein the support plate is secured on the outer bag.

12. A double bag as set forth in claim 11, wherein the support plate is welded to the outer bag.

13. A double bag as set forth in claim 11, wherein the support plate is folded around an unsealed edge of the outer bag.

14. A double bag as set forth in claim 13, wherein the support plate forms a book back-like web upon having been folded around the unsealed edge.

15. A double bag as set forth in claim 14, wherein the book back-like web has a width from, 4 to 8 mm.

16. A double bag as set forth in claim 15, wherein the look back-like web had a width of 6 mm.

17. A double bag as set forth in claim 13, wherein the support plate has a bay-shaped notch in an unfolded condition thereof.

18. A double bag as set forth in claim 11, wherein the support plate is welded to a side wall of the outer bag having a punched-out opening in a region of the opening device and the discharge device, the support plate being welded to the side wall around the punch-out opening.

19. A double bag as set forth in claim 18, wherein the punch-out opening in the side wall has a substantially oval shape.

20. A double bag as set forth in claim 1, wherein each of the inner bag and the outer bag has three sealing seams.

21. A double bag as set forth in claim 20, wherein unsealed edges of the inner bag and the outer bag are arranged adjacent to each other.

22. A double bag as set forth in claim 1, wherein the inner bag has a rib for securing the inner bag in the outer bag and projecting beyond a sealing seams, the rib projecting beyond the sealing seam by 2–12 mm.

23. A double bag as set forth in claim 22, wherein the rib projects beyond the sealing seam by 6 mm.

24. A double bag as set forth in claim 22, wherein the inner bag is welded to the outer bag along the rib by one of a seam welding and spot welding, with the one of a welding seam and welding spots defining a fixation seal.

25. A double bag as set forth in claim 24, further comprising a further sealing seam located outwardly of the fixation seal.

26. A double bag as set forth in claim 1, wherein an upper sealing seam of the outer bag has, in a use position of the double bag, a width from 8 to 20 mm.

27. A double bag as set forth in claim 26, wherein the upper sealing seam has a width of 14 mm.

28. A double bag as set forth in claim 26, further comprising one of a circular opening and an omega-shaped suspension opening at least partially formed in the upper sealing seam.

29. A double bag as set forth in claim 28, wherein the suspension opening is located diametrically opposite a discharge device provided in the outer bag, an openable location of the inner bag being located substantially on a connection line between the discharge device and the suspension opening.

* * * * *